US007383962B2

(12) United States Patent
Webster et al.

(10) Patent No.: US 7,383,962 B2
(45) Date of Patent: Jun. 10, 2008

(54) MODEL TRAIN WITH IMPROVED COUPLING MECHANISM

(75) Inventors: Richard F. Webster, Carson, CA (US); Steven R. Greening, Grosse Pointe Woods, MI (US)

(73) Assignee: Lionel L.L.C., Chesterfield, MI (US)

( * ) Notice: Subject to any disclaimer, the term of this patent is extended or adjusted under 35 U.S.C. 154(b) by 251 days.

(21) Appl. No.: 11/139,277

(22) Filed: May 27, 2005

(65) Prior Publication Data

US 2006/0054582 A1 Mar. 16, 2006

Related U.S. Application Data

(60) Provisional application No. 60/575,594, filed on May 28, 2004.

(51) Int. Cl.
*B61G 1/00* (2006.01)

(52) U.S. Cl. ..... 213/75 TC; 105/1.5; 105/3

(58) Field of Classification Search ..... 105/1.5, 105/8.1, 10, 21, 3, 4.1; 213/75 R, 74, 75 TC
See application file for complete search history.

(56) References Cited

U.S. PATENT DOCUMENTS

| | | | | |
|---|---|---|---|---|
| 269,839 | A * | 1/1883 | Du Bois | 105/439 |
| 3,469,713 | A * | 9/1969 | Edwards et al. | 213/75 TC |
| 4,903,612 | A * | 2/1990 | Sassa et al. | 105/18 |

FOREIGN PATENT DOCUMENTS

| | | |
|---|---|---|
| DE | 34 12 626 | * 10/1985 |
| DE | 40 20 756 | * 8/1991 |

* cited by examiner

*Primary Examiner*—Mark Le
(74) *Attorney, Agent, or Firm*—O'Melveny & Myers LLP

(57) ABSTRACT

A model train car uses an improved coupling mechanism that permits close coupling of adjacent cars in a model train, while also providing a rotational operating range that permits operation of the train with tighter model track curves. The coupling mechanism operates to extend a coupling bar from the model car when the train turns to the right or left, providing clearance for further rotation of the bar. The mechanism further provides for elastic portions of the model car housing, which give way to the rotating coupling bar as the bar rotates towards its outer limits.

17 Claims, 3 Drawing Sheets

MODEL TRAIN WITH IMPROVED COUPLING MECHANISM

CROSS-REFERENCE TO RELATED APPLICATION

This application claims priority pursuant to 35 U.S.C. § 119(e) to U.S. Provisional Application No. 60/575,594, filed May 28, 2004, which application is specifically incorporated herein, in its entirety, by reference.

BACKGROUND OF THE INVENTION

1. Field of the Invention

The present invention relates to model vehicles, such as model trains, and more particularly, to a coupling mechanism for a model train or other model vehicle.

2. Description of Related Art

Various model trains and vehicles are known in the art, which model an actual or imaginary train or vehicle at a reduced scale. Many model trains include a model locomotive driven by an engine. The locomotive is constructed to run on a model railway track. Various types of model tracks may be provided for different kinds of trains. For many trains, a hobbyist may obtain short segments or sections of pre-assembled model track. Track sections may include, for example, straight sections, curve sections having various radii, switches, and junctions. The track sections may be assembled and combined in various ways to construct a model track layout. Various model cars without engines are also available, which may be connected in various ways with one or more model locomotives to form trains.

Model train cars may be coupled together to form a model train using various coupling mechanisms. For instance, drawbar connectors, c-shaped connectors (knuckle couplers), and ball and hitch connectors may be used to connect adjacent train cars together. Some such couplings are generally reliable and easy to couple and decouple. Some obtain higher levels of realism than others. Notwithstanding their advantages, however, couplings for model train cars may be subject to certain disadvantages. In conventional coupling arrangements, the movement of the coupling member in both directions may be limited by the outer structure of the train car. For example, when a train encounters a curve in a model track, the coupling member associated with that train car moves in the direction of the curve. If the radius of the curve is too small, the coupling member may come into contact with the structure of its connected train car. In other words, the range of travel of the coupling member is physically limited by the rigid structure of the train car. A greater range of rotation may be achieved by increasing the length of the coupling drawbar, but this may cause the train cars to be coupled too far away from one another, lending to unrealistic appearance to the train as a whole.

The turning radius of the train may therefore be limited by the coupling member. Model train hobbyists may therefore be limited in their selection of track, and may not be able to construct layouts having curves that have a desired tightness in radius. Large-radius curves, in turn, may disadvantageously require a larger number of track sections to construct, and may cause a track layout to occupy more space than desired. In addition, the constraints imposed by prior-art coupling mechanisms may increase the chance of derailment of the train car, particularly when the train is moving at a relatively high speed.

Accordingly, a need exists for a model train with an improved coupling mechanism that overcomes these and other limitations of the prior art.

SUMMARY OF THE INVENTION

The invention provides a reduced-scale model train car with an improved coupling mechanism. A train assembled using cars according to the invention should be able to negotiate tracks having tighter-radius curves than was possible using prior-art coupling mechanisms, without sacrificing a close-coupled appearance.

A model train car in accordance with the present invention comprises a housing shaped to resemble an actual or fanciful train car. The model train further includes a coupling mechanism attached to the model train car. The coupling mechanism comprises a drawbar or other elongated structure connected to a lower frame of the model rail car, having a coupling disposed at a distal end thereof. The coupling is configured to mate with a complementary coupling of an adjacent model car.

The drawbar may be moveably connected to the model rail car. In an embodiment of the invention, the drawbar is connected to the train car using a special sliding and rotating connection structure that permits the drawbar to both rotate and move linearly relative to the rail car. When the model train is traversing a straight section of track, the special connector is configured to retract the drawbar in towards the center of the model car, drawing adjacent cars closer together. When the train is traversing a curve, the connector is configured to both rotate and extend away from the model car. The extending action advantageously provides additional clearance between the coupling at the frame or body of the model car. This additional clearance may permit a greater degree of rotation of the drawbar, and hence, permit the train to negotiate a tighter curve. As the train exits the curve, the drawbar rotates back towards the center of the car and retracts.

In embodiments of the invention, the extending action of the drawbar may not provide the desired degree of rotation between cars. The extending action of the rotating and sliding connector may tend to be limited by design constraints such as available space and range of reliable motion for a cost-effective design. The coupling end of the drawbar may therefore still tend to interfere with the body of the train car near the corners of the car. To lessen such interference and permit greater rotation of the drawbar, segments of the body at the four corners of the car may be configured to be movable via an elastic connection with the body or frame. For example, segments at the corners of the body may be attached to the body via an elastic hinged or sliding connection. When the train negotiates a tight curve, rotational forces on the drawbar push the nearest corner segment outward, permitting greater rotation of the coupling mechanism and hence, adjacent train cars, than would otherwise be possible. As the train straightens out, the drawbar stops pushing on the moveable corner segment, which therefore returns to its rest position under the impetus of a return spring or other elastic member.

It should be apparent that the moveable corner segment of the invention may be implemented entirely separately from the remainder of the coupling mechanism. For example, a standard vehicle frame and coupling mechanism may be fitted to a train car body having moveable corner segments, thereby providing a train car having a coupling mechanism permitting greater rotation than with a prior-art car body. In the alternative, the moveable-corner feature may be implemented partly or wholly in association with the vehicle frame.

A more complete understanding of the model vehicle with coupling mechanism will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

The present invention provides a model vehicle with an improved coupling mechanism, that overcomes the limitations of the prior art. In the detailed description that follows, like element numerals are used to indicate like elements appearing in one or more of the figures.

Figure 1:
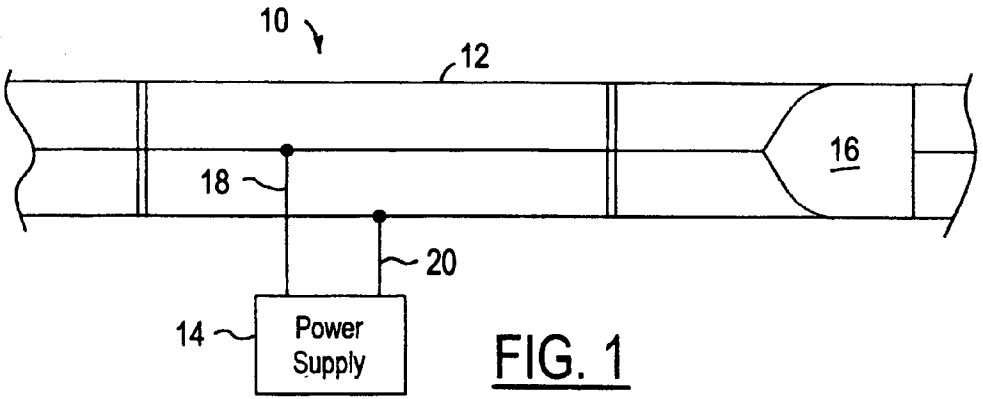
FIG. 1 is a plan view of a model railroad layout in accordance with the present invention.

FIG. 1 shows a first exemplary embodiment of a model vehicle system 10. Model vehicle system 10 includes a track 12, a power supply 14, a train 16 and a control box 18. In an exemplary embodiment, track 12 may comprise a three rail track that is configured for travel thereon by train 16. Power source 14 provides power to track 12 by way of connectors 18 and 20, whereby the power terminal of the power supply is connected to the center or third rail of track 12, and the neutral terminal is connected to at least one of the two outer rails of track 12. Train 16 may be configured with contacts on the bottom thereof, or an arrangement of electrically conductive metallic wheels, to pick up the applied power and supply it to the electric motor of the train. Train 16 may comprise a plurality of train cars connected by coupling members according to the invention, as described in more detail below. The arrangement described above is for exemplary purposes only and is not meant to be limiting in nature.

Figure 2:
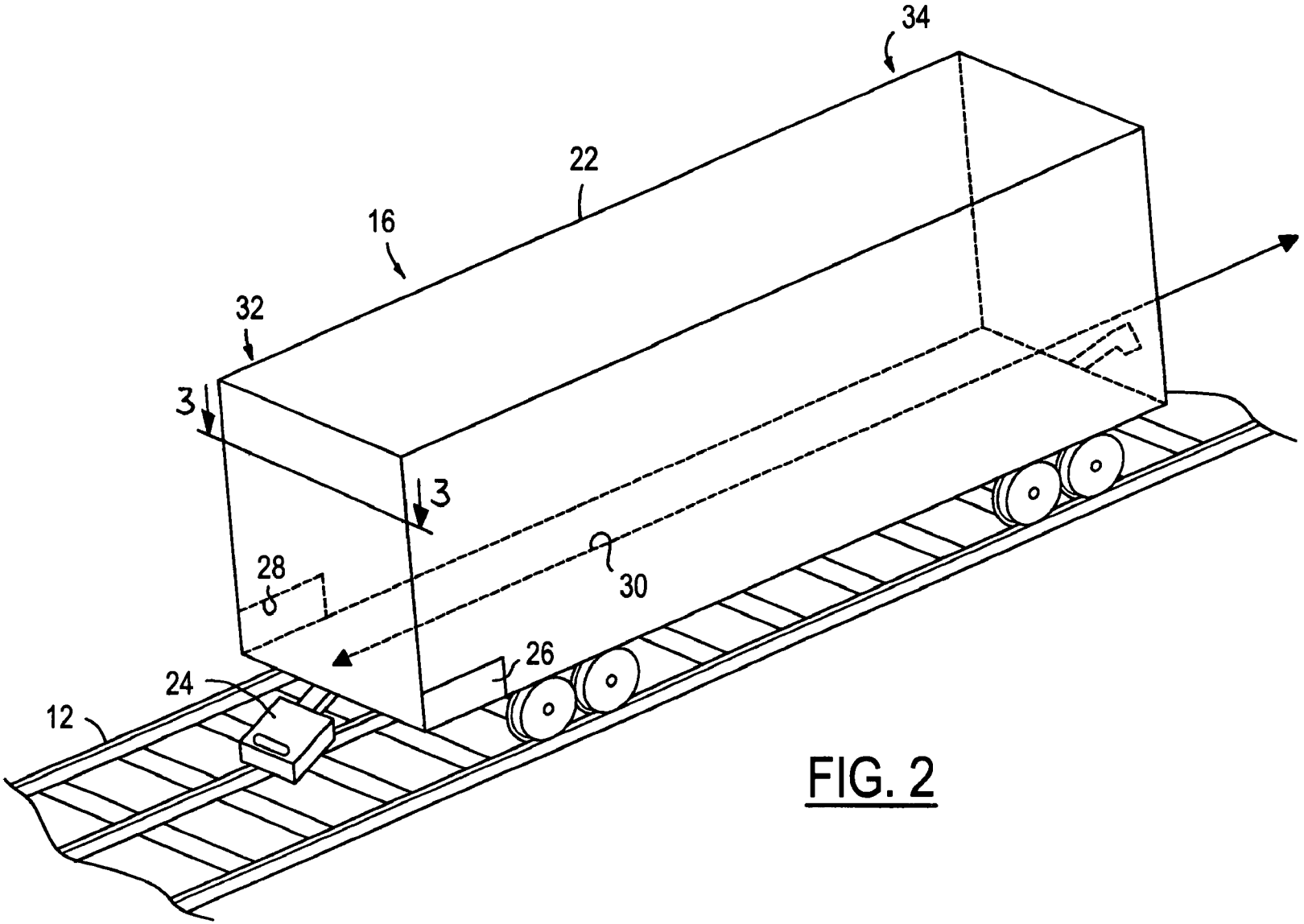
FIG. 2 is a simplified perspective view of a model train car in accordance with the present invention.
Figure 3:
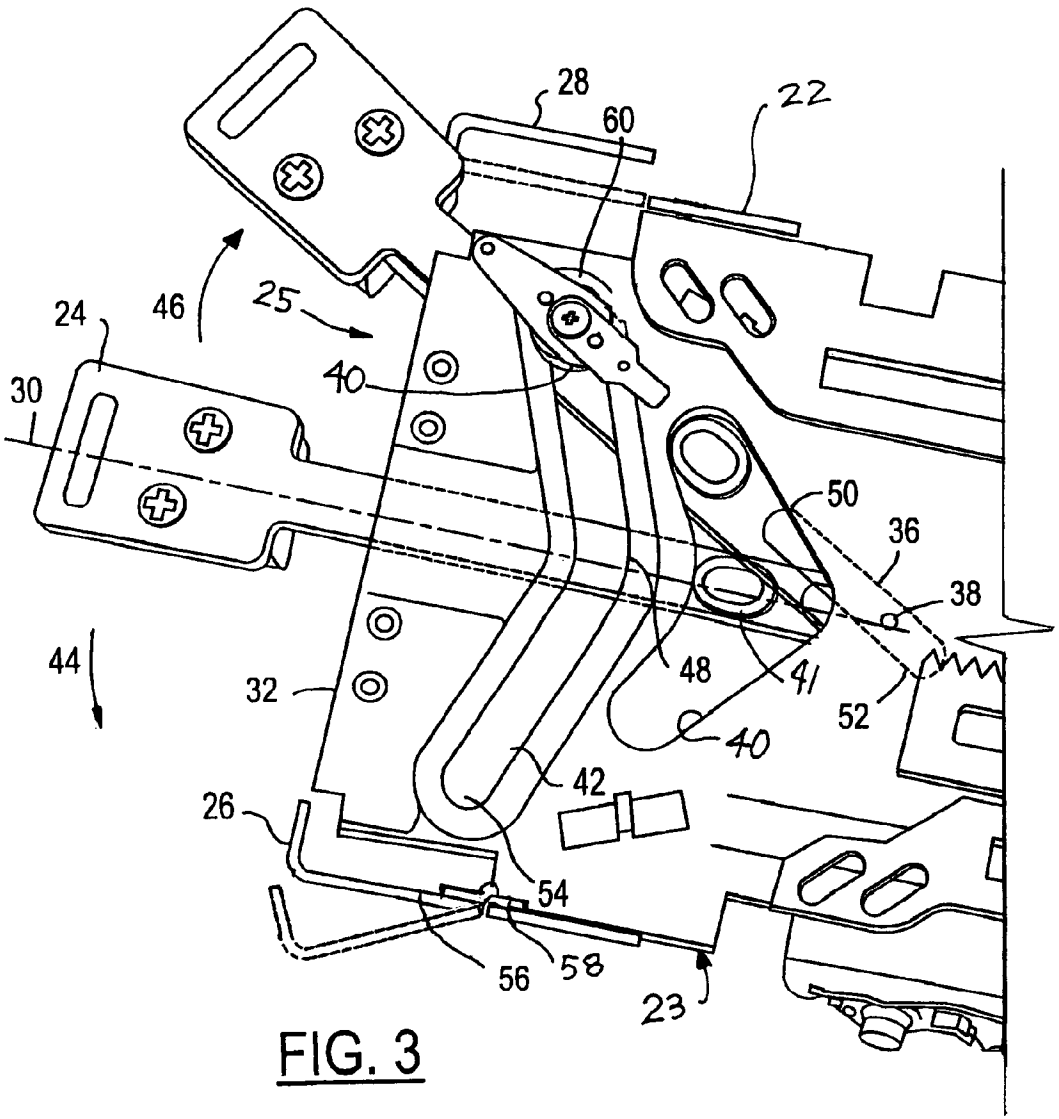
FIG. 3 is a partial cross section view along lines 3-3 of FIG. 2 of a coupling mechanism shown in accordance with the present invention.

With reference to FIGS. 2 and 3, in an embodiment of the invention, train car 16 includes a housing or body 22, a coupling member 24, first corner section 26, and a second corner section 28. A lower portion of car 16 may comprise a lower frame 23. A longitudinal axis 30 may be defined extending from a first end 32 of housing 22 to a second end 34 of housing 22. First and second corner sections 24, 26 may be disposed in or on a perimeter of housing 22. A static coupling may be used at the rear 34 of each car 16 in a train, to pull moveable couplings in trailing cars. In the alternative, a moveable rear coupling using a mechanism like the described coupling mechanism, or a simplified mechanism, may likewise be disposed at a rear 34 of car 16. A model train according to the invention may comprise any desired number of interconnected cars like train 16, and may be pulled by one or more model locomotives.

With reference to FIG. 3, details of an exemplary coupling mechanism 25 for car 16 are shown. Mechanism 25 may be connected to a lower frame 23 of car 16 under housing 22. Mechanism 25 may comprise a connecting member 24 configured to be affixed to train 16 and to couple with a complementary connecting member, e.g., a rear coupling, for a second train car. It should be apparent that in FIG. 3, two connector members 24 are shown, representing alternative positions of the member during operation. In reality, mechanism 25 should comprise a single connector member 24.

In an exemplary embodiment, coupling member 24 comprises a drawbar connector pivotally coupled to car 16. Coupling member 24 may comprise an elongated slot 36 in its distal portion, within which a fixed pin 38 protruding from an underside of frame 23 may be disposed. Pin 38 may be configured to retain member 24, while still permitting it to extend and retract relative to frame 23 and car 16. At the same time coupling member 24 is free to pivot about fixed pin 38.

Coupling mechanism 25 may further comprise a second guide member 40 protruding from member 24 and passing through a V-shaped slot 42 in frame 23. Guide member 40 may comprise a pin, roller, or other suitable guide. Guide member 40 may be disposed within slot 42 so as to be guided as coupling member 24 moves from side-to-side of frame 23, i.e., in a first radial direction 44 relative to longitudinal axis 30, and a second radial direction 46 opposite first radial direction 44. Slot 42 may comprise a V-shaped slot, or other suitable shape such as C-shaped or U-shaped. Slot 42 should be configured such that when car 16 and an adjacent connected car are being pulled and traversing a straight section of track, coupling member 24 is substantially aligned with a central longitudinal axis 30 of car 16, and guide member 40 is located substantially at the vertex or minima 48 of slot 52 furthest from the end 32 of frame 23. At the same time, fixed pin 38 is disposed at or near a first end 50 of elongated slot 36. Accordingly, coupling member 24 is retracted in an axial direction under frame 23 and towards the center of car 16, resulting in a close coupling relative to the adjacent train car.

In comparison, when car 16 and adjacent cars are pulled along a curved portion of track, for example a track curved towards the right, coupling member 24 is urged in a radial direction 46 (i.e., to the right). As train 16 turns, coupling member 24 pivots about and slides along fixed pin 38, such that pin 38 is disposed at or near a right distal end 52 of elongated slot 36. Coupling member 24 therefore extends out from frame 23 in an axial direction. Likewise, when traversing a leftward curve, coupling member 24 moves in a left radial direction 44 and guide member 40 rides outwardly within V-shaped slot 42 towards a left distal end 54 of V-shaped slot 42 near the perimeter of housing 22. Thus, coupling member 24 extends outward from frame 23 and rotates when car 16 and an adjacent car are traversing a curved section of track. As should be apparent from FIG. 3, the outward extension of the coupling permits a greater degree of coupling rotation than would otherwise be possible. Hence, a train using a coupling mechanism according to the invention may rotate to a greater degree with respect to an adjacent car, permitting the cars to traverse a tighter curve.

Optionally, any number of additional or alternative guide mechanisms may be provided, for example, second guide slot 43 in frame 23, cooperating with a guide stud 41 in member 24. The second guide mechanism may assist in smoother operation of the primary guide provided by slot 42 and guide member 40.

Notwithstanding the advantages of the coupling mechanism as described thus far, in some cases the degree of possible rotation may still not be as great as desired. Lower corners of a train car body 22 often extend below the level of lower frame 23, and thus may prevent coupling 24 from rotating to its mechanical limit. The invention therefore provides a method and apparatus for overcoming this limitation, as described below.

Figure 4B:
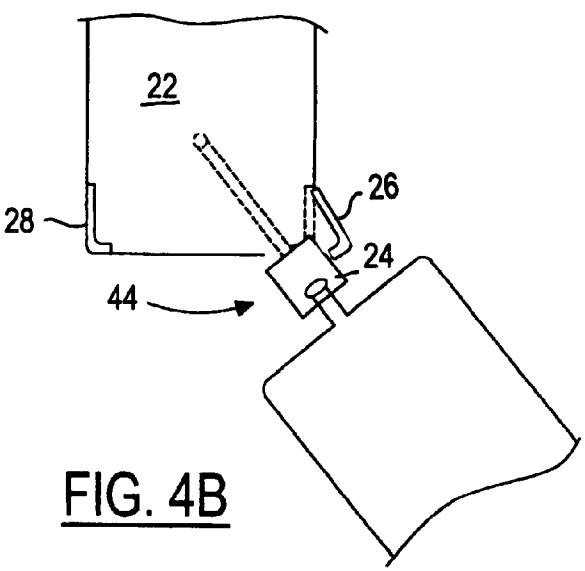
FIGS. 4A-B are schematic plan views of a coupling arrangement of a model train in accordance with the present invention.

With reference to FIGS. 3-4B, moveable corner segments 26, 28 may be provided in housing 22 at its lower corners. These corner pieces may be formed separately from body 22, and moveably connected to the remainder of the car body 22 so as to appear flush or integral with it. Frame 23 may be relieved or removed adjacent to the corner piece, as shown in FIG. 3. A spring or other elastic member may be used to keep each corner piece in its rest position. When rotation of coupling member 24 causes it to contact either of corner pieces 26, 28, the corner piece moves outward from the car body 22, permitting continued rotation of the coupling member. The coupling mechanism may thereby be afforded freedom to move through its entire side-to-side range as described above.

The invention is not limited to a particular mechanism by which the corner pieces are made moveable. For example, a hinge 58 as shown adjacent to piece 26 in FIG. 3 may be suitable, and may be coupled with a suitable spring (not shown), as known in the art. Generally, the corner pieces may be mounted using an elastic coupling of any suitable type, for example a a pivoting, sliding or stretching coupling, to give way to the coupling member when it is rotated against them. The illustrated embodiments exemplify two different structures for mounting the corner pieces 26, 28, which for economy of illustration are shown together on a single frame. Corner piece 26 is shown pivoting outward, while the depicted motion of piece 28 is consistent with a coupling that slides outward or pivots upward and outward. It should be appreciated, however that it may be advantageous to use the same mounting structure for corner pieces in a particular train car 16. Corner pieces may be of any desired size or length, and may even extend for substantially the entire length of car 16 to form a lower skirt. Generally, however, it is believed advantageous to keep corner pieces 26, 28 as small as possible while still remaining functional.

Figure 4A:
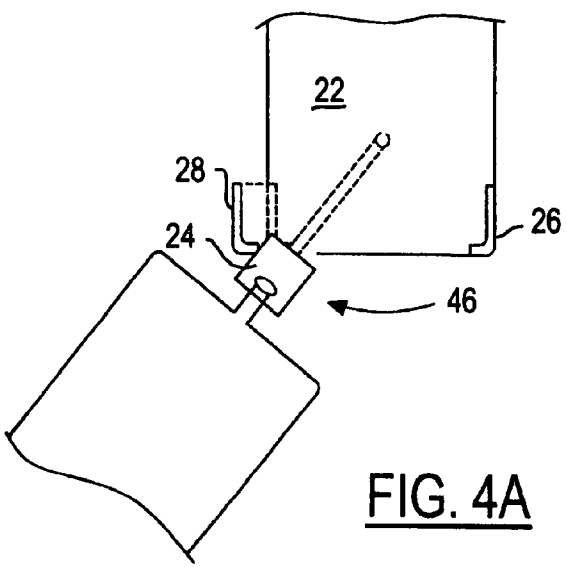

A first exemplary corner piece 28 is shown in FIGS. 3 and 4A. Corner piece 28 may be mounted to housing 22 so as to be displaced laterally from the longitudinal axis 30 of car 16 in the plane of coupling member 30. For example, piece 28 may be hinged to body 22 at a location above the plane of coupling member 24. In the alternative, corner piece 28 may be mounted on a sliding mechanism to frame 23 or body 22. As coupling member 24 is pulled rightward 46 by a leading car traversing a rightward curve, it contacts corner piece 28 and pushes it outward while continuing its rightward rotation. After completing the curve, the leading car pulls the coupling member back towards the centerline 30 of car 16. A spring or other elastic member may be used to return the corner piece to its rest position. In the alternative, or in addition, corner piece 28 may be designed so that it is returned to its rest position by gravity.

A second exemplary corner piece 26 is shown in FIGS. 3 and 4B. Corner piece 26 exemplifies a laterally hinged structure for holding the corner piece to body 22. When pulled leftward by a leading car, coupling member contacts corner piece 26 and pivots it outward, in the direction 44 of rotation of the coupling member. After the coupling member returns to a center position, a spring or other elastic member may be used to urge the pivoting corner piece 26 back to its rest position.

The present invention thereby provides a close coupling for model trains, without sacrificing the ability of the model train to negotiate curve sections having a relatively tight radius.

Having thus described a preferred embodiment of a model vehicle with an improved coupling mechanism, it should be apparent to those skilled in the art that certain advantages of the within system have been achieved. It should also be appreciated that various modifications, adaptations, and alternative embodiments thereof may be made within the scope and spirit of the present invention. For example, a particular coupling mechanism has been illustrated, but it should be apparent that the inventive concepts described above would be equally applicable to other coupling mechanisms arranged according to the spirit and scope of the invention. The invention is defined by the following claims.

What is claimed is:

1. A model train car, comprising:

a reduced-scale model housing, the model housing comprising a remainder section and a pair of pivotally mounted corner sections;

a lower structural frame supporting the housing; and a coupling mechanism connected to the lower frame, the coupling mechanism comprising an elongated coupling bar connected to the lower frame via a pivoting and sliding connector and extending past a leading edge of the frame, and a guide disposed between the lower frame and the coupling bar, the guide comprising a guide member disposed in a guide slot, wherein the guide member is connected to the coupling bar and the guide slot is shaped to direct the guide member towards the leading edge of the frame when the coupling bar is pivoted away from a centerline of the model train car, wherein the pair of corner sections are disposed at opposite corners of the model housing towards the coupling mechanism and are moveably connected to the model housing so as to be substantially flush with the remainder section and form opposite corners of the model housing.

2. The model train car of claim 1, wherein the corner sections are mounted to the model housing.

3. The model train car of claim 1, wherein the corner sections are mounted to the frame.

4. The model train car of claim 1, further comprising an elastic member disposed adjacent to each of the corner sections.

5. The model train car of claim 1, further comprising a first elastic member disposed adjacent to a first one of the corner sections and configured to return the first one of the corner sections to a rest position, and a second elastic member disposed adjacent to a second one of the corner sections and configured to return the second one of the corner sections to a rest position.

6. The model train car of claim 1, wherein a first one of the corner sections is configured to give way to rotation of the coupling member on a first side of the housing.

7. The model train car of claim 1, wherein a second one of the corner sections is configured to give way to rotation of the coupling member on a second side of the housing.

8. The model train car of claim 1, wherein the pivoting and sliding connector comprises a pin disposed in an elongated slot.

9. The model train car of claim 1, further comprising a second guide slot disposed in the lower frame, and a second guide member connected to the coupling bar, wherein the second guide member is disposed in the slot.

10. The model train car of claim 1, wherein the guide member comprises a roller.

11. The model train car of claim 1, wherein the guide slot comprises a V-shaped slot.

12. A model train comprising:

a plurality of interconnected model train cars, wherein each of the model cars comprises a lower structural frame supporting a housing and an associated coupling mechanism connected to the lower frame, the coupling mechanism comprising an elongated coupling bar connected to the lower frame via a pivoting and sliding connector and extending past a leading edge of the frame, and a guide disposed between the lower frame and the coupling bar, the guide comprising a guide member disposed in a guide slot, wherein the guide member is connected to the coupling bar and the guide slot is shaped to direct the guide member towards the leading edge of the frame when the coupling bar is pivoted away from a centerline of the model train car, the model train thereby comprising a plurality of coupling mechanisms, wherein each of the plurality of model train cars is connected to an adjacent one of the plurality of model train cars by a corresponding one of the plurality of coupling mechanisms, wherein the housing for each of the model cars comprises a remainder section and a pair of pivotally mounted corner sections disposed at opposite corners of the model housing towards the associated coupling, wherein the pair of corner sections are moveably connected to the model housing so as to be substantially flush with the remainder section and form opposite corners of the model housing.

13. The model train of claim 12, wherein each of the model cars further comprises a first elastic member disposed adjacent to a first one of the corner sections and configured to return the first one of the corner sections to a rest position, and a second elastic member disposed adjacent to a second one of the corner sections and configured to return the second one of the corner sections to a rest position.

14. The model train of claim 12, wherein a first one of the corner sections of each of the model cars is configured to give way to rotation of the associated coupling member on a first side of the housing.

15. The model train of claim 12 wherein a second one of the corner sections of each of the model cars is configured to give way to rotation of the coupling member on a second side of the housing.

16. A model train car, comprising:

a reduced-scale model housing, the model housing comprising a remainder section and a pair of pivotally mounted corner sections, wherein the pair of corner sections are moveably connected to the model housing so as to be substantially flush with the remainder section and form opposite corners of the model housing;

a lower structural frame supporting the housing;

an elongated coupling bar pivotally connected to the lower frame and extending from a front edge of the frame; and guide means for extending the coupling bar out from the train car when the coupling bar is pivoted away from a centerline of the model train car, the guide means operatively disposed between the coupling bar and the lower frame.

17. A model train car, comprising:

a reduced-scale model housing;

a lower structural frame supporting the housing;

a coupling mechanism connected to the lower frame, the coupling mechanism comprising an elongated coupling bar connected to the lower frame via a pivoting and sliding connector and extending past a leading edge of the frame, and a guide disposed between the lower frame and the coupling bar, the guide comprising a guide member disposed in a first guide slot, wherein the guide member is connected to the coupling bar and the guide slot is shaped to direct the guide member towards the leading edge of the frame when the coupling bar is pivoted away from a centerline of the model train car, wherein the pivoting and sliding connector comprises a pin disposed in an elongated slot; and a separate second guide slot disposed in the lower frame, and a second guide member connected to the coupling bar, wherein the second guide member is disposed in the second guide slot.

* * * * *